US005860684A

United States Patent [19]

Mizuki

[11] Patent Number: 5,860,684

[45] Date of Patent: Jan. 19, 1999

[54] OUTER OPEN HANDLE ASSEMBLY AND LATCH ASSEMBLY OF MOTOR VEHICLE

[75] Inventor: Tetsuro Mizuki, Nirasaki, Japan

[73] Assignee: Mitsui Kinzoku Kogyo Kabushiki Kaisha, Tokyo, Japan

[21] Appl. No.: 741,099

[22] Filed: Oct. 30, 1996

Related U.S. Application Data

[63] Continuation of Ser. No. 441,694, May 15, 1995, abandoned.

[30] Foreign Application Priority Data

May 13, 1994 [JP] Japan ..... 6-124483

[51] Int. Cl.[6] ..... E05B 1/00

[52] U.S. Cl. ..... 292/336.3; 292/347; 292/DIG. 53

[58] Field of Search ..... 292/336.3, DIG. 15, 292/DIG. 31, DIG. 53, DIG. 23, 347, 348, 350, 357, 216, 223, 196; 70/207, 209, DIG. 42

[56] References Cited

U.S. PATENT DOCUMENTS

| | | | |
|---|---|---|---|
| 1,334,320 | 3/1920 | Schmidgall | 292/216 |
| 1,529,085 | 3/1925 | Preble | 292/223 |
| 2,029,197 | 1/1936 | Roedding | 292/223 |
| 2,210,495 | 8/1940 | North | 292/223 |
| 2,912,270 | 11/1959 | Hawkins | 292/223 |
| 2,944,849 | 7/1960 | Falk | 292/223 |
| 4,898,415 | 2/1990 | Satoh . | |
| 5,040,393 | 8/1991 | Rossebo | 292/DIG. 53 |
| 5,096,239 | 3/1992 | Rippberger | 292/DIG. 53 |
| 5,141,266 | 8/1992 | Braun | 292/216 |

*Primary Examiner*—Steven Meyers
*Assistant Examiner*—Gary Estremsky
*Attorney, Agent, or Firm*—Browdy and Neimark

[57] ABSTRACT

An apparatus for opening and closing a vehicle door comprises an outer open handle assembly and a latch assembly. The handle assembly has an handle base which is brought into contact with an outer surface of an outer door panel and a handle lever which is rotatably mounted on the handle base. The latch assembly has a bracket which is brought into contact with an inner surface of the outer panel, a latch mechanism which is engaged with a striker and mounted on the bracket, and an opening mechanism which is operative to release the latch mechanism and mounted on the bracket. The handle base and the bracket are fixed to each other with screws or bolts across the outer door panel. The latch assembly is covered with a decorative case.

14 Claims, 3 Drawing Sheets

OUTER OPEN HANDLE ASSEMBLY AND LATCH ASSEMBLY OF MOTOR VEHICLE

This application is a continuation of application Ser. No. 08/441,694, filed May 15, 1995, now abandoned.

BACKGROUND OF THE INVENTION

1. Field of the Invention

This invention relates to an outer open handle assembly and a latch assembly of a motor vehicle.

2. Description of the Related Art

As disclosed in the U.S. Pat No. 4,898,415, a conventional outer handle assembly has a handle base which is mounted on the outer surface of an outer panel of a door, and a bracket which is mounted on the inner surface of the outer door panel, and both of the handle base and the bracket are fixed to each other across the outer door panel.

A conventional door latch assembly which is mounted on the inner part of the outer door panel away from the handle assembly is connected to the outer open handle assembly through a rod or a wire cable is mounted on the inner part of the outer door panel away from the handle assembly.

The conventional handle and latch assemblies have several disadvantages.

First, as the latch assembly is provided away from the handle assembly, the rod or the wire cable is considerably long. Such a long rod or wire cable is susceptible to an influence of a large distortion of a door, which is caused in an accident. Therefore, careful considerations should be given to the design of a door.

Second, because the handle assembly and the latch assembly are mounted on the door independent of each other, two mounting operations must be made.

SUMMARY OF THE INVENTION

Accordingly, an object of the present invention is to provide an apparatus having a handle assembly and a latch assembly, which does not substantially require a rod or a wire cable for a connection therebetween.

Further, another object of the present invention is to provide an apparatus having a handle assembly and a latch assembly, the number of mounting operations of which can be reduced.

To achieve the foregoing objects, in accordance with the present invention, there is provided an apparatus in which a handle assembly and a latch assembly are mounted on both sides of an outer door panel, respectively, in such a manner that the handle assembly is in opposing relation with the latch assembly, and in which the handle assembly and the latch assembly are fixed to each other with bolts.

BRIEF DESCRIPTION OF THE DRAWINGS

Other features, objects and advantages of the present invention will become apparent from the following description of a preferred embodiment with reference to the drawings in which like reference characters designate like or corresponding parts throughout several views, and in which.

DETAILED DESCRIPTION OF THE PREFERRED EMBODIMENT

Hereinafter, the preferred embodiment of the present invention will be described in detail by referring to the accompanying drawings.

Figure 1:
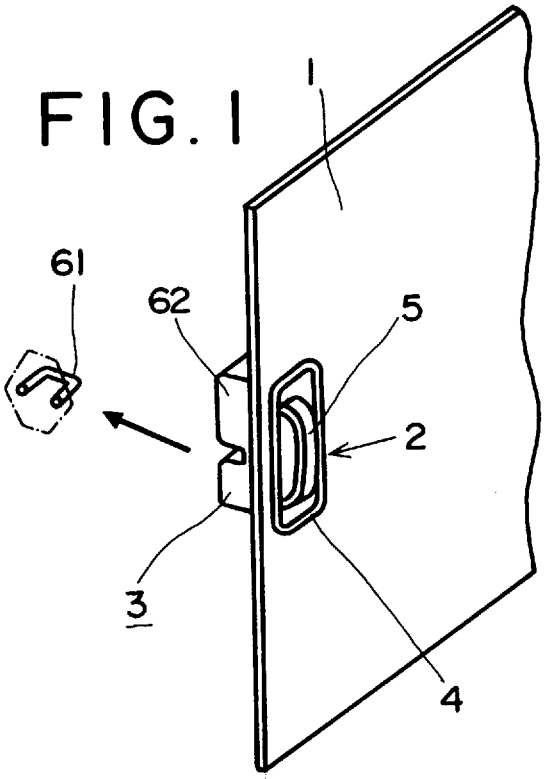
FIG. 1 is a schematic diagram for illustrating a motor vehicle door on which an outer open handle assembly and a latch assembly of the present invention are mounted.
Figure 4:
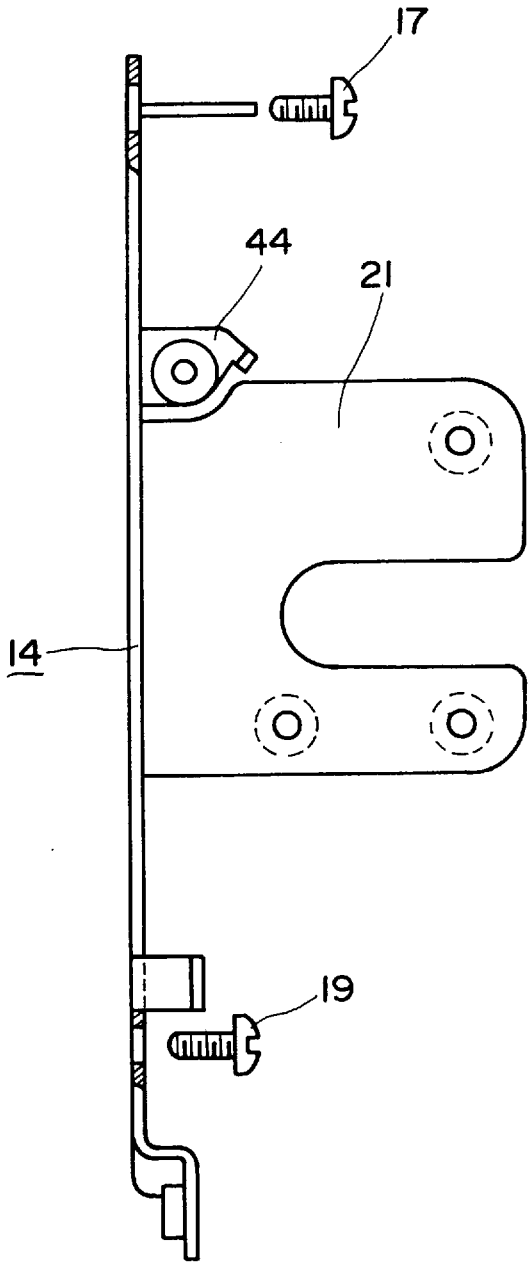
FIG. 4 is a side of a base bracket of the latch assembly of the present invention.

FIG. 1 illustrates an outer panel or plate 1 of a door of a motor vehicle, on which an outer open handle assembly 2 and a latch assembly 3 are mounted. The handle assembly 2 and the latch assembly 3 are mounted on both surfaces of the outer panel 1, respectively, in such a manner as to be in opposing relation with each other. Either of a metal plate and a glass plate may be used as the outer panel 1. Inner panel and dressing panel of the door are omitted in FIG. 1.

Figure 2:
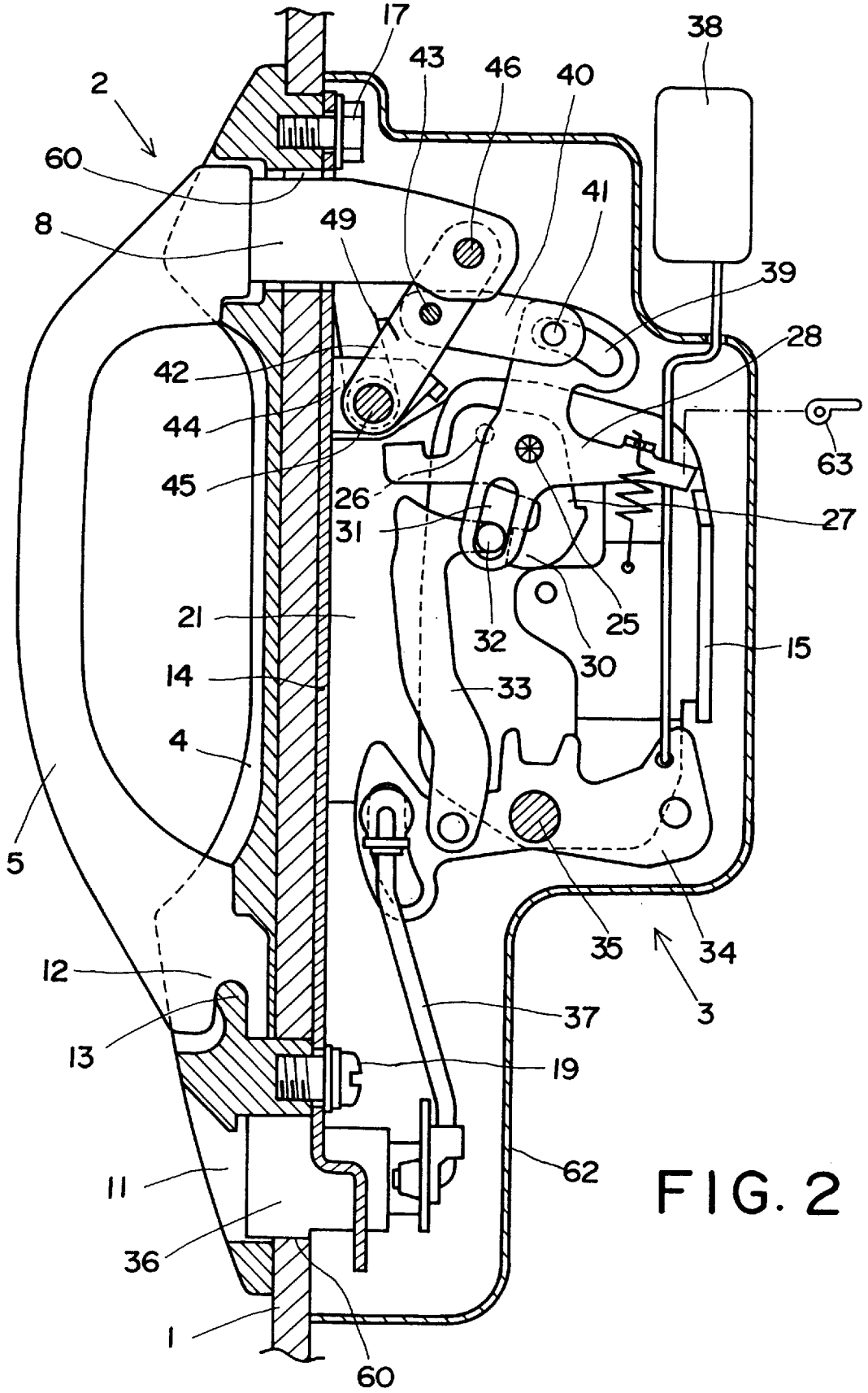
FIG. 2 is a partially longitudinal sectional view of the handle assembly and the latch assembly of the present invention.
Figure 3:
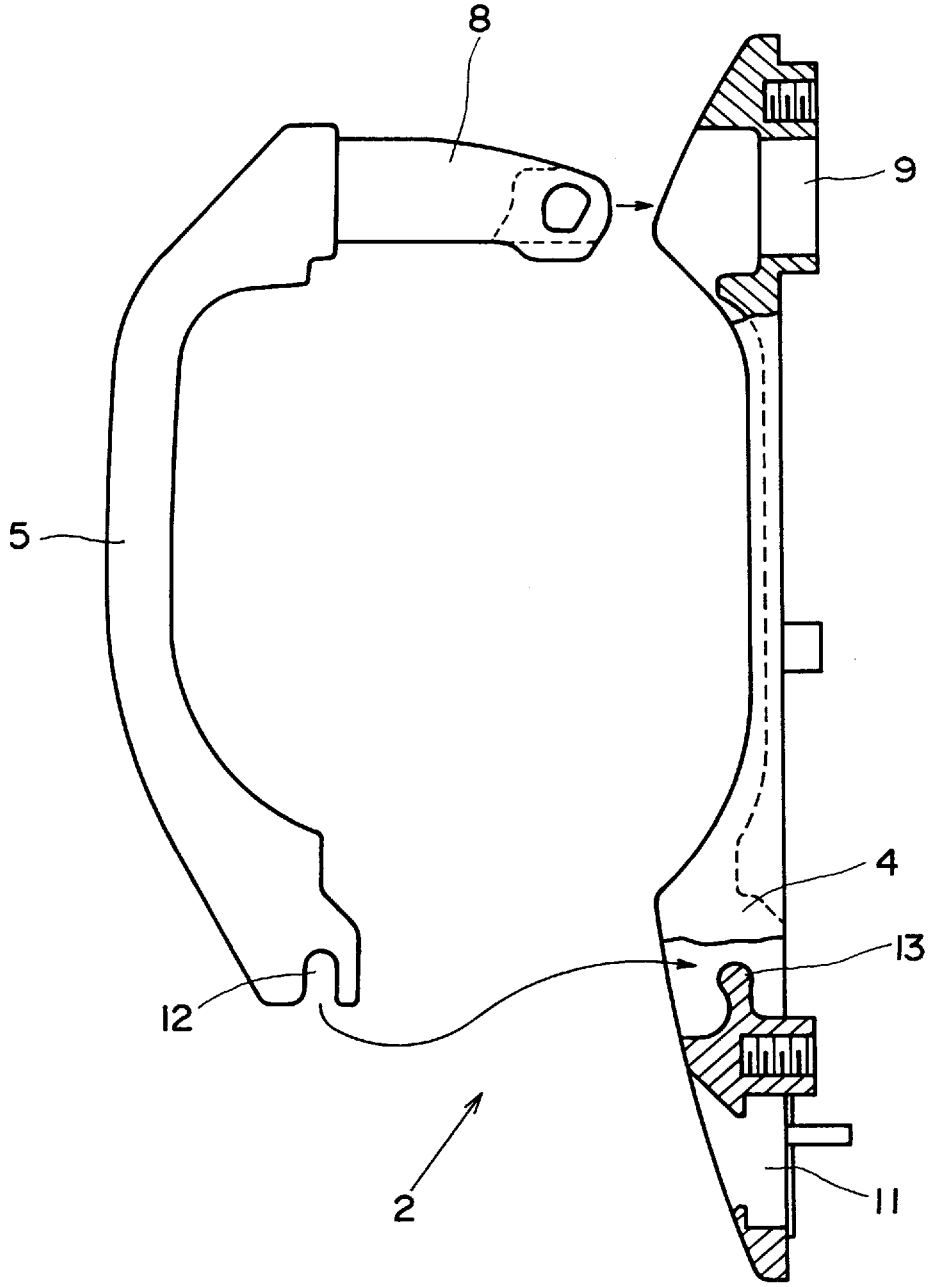
FIG. 3 is an exploded view of the handle assembly of the present invention.

As shown in FIGS. 2 and 3, the handle assembly 2 has a handle base 4, which is brought into an abutting engagement with the outer surface of the outer panel 1, and a handle lever 5 pivotally movably supported on the handle base 4. The handle base 4 has a supporting portion 13 with which a U-shaped concave portion 12 of the handle lever 5 is engaged. The handle base 4 also has a window 11 through which a keyhole of a door key cylinder 36 is exposed to the exterior, and an aperture 9 into which an arm 8 of the handle lever 5 is inserted. The arm 8 and the key cylinder 36 project toward the inner side of the door panel 1 through openings 60 and 60 of the panel 1, respectively, as illustrated in FIG. 2.

The latch assembly 3 has a base bracket 14 to be mounted on the inner surface of the outer panel 1 and a latch unit 15 fastened to the bracket 14 with screws or bolts (not shown). The bracket 14 and the handle base 4 are fixed to each other with screws or bolts 17 and 19 across the outer panel 1.

Figure 5:
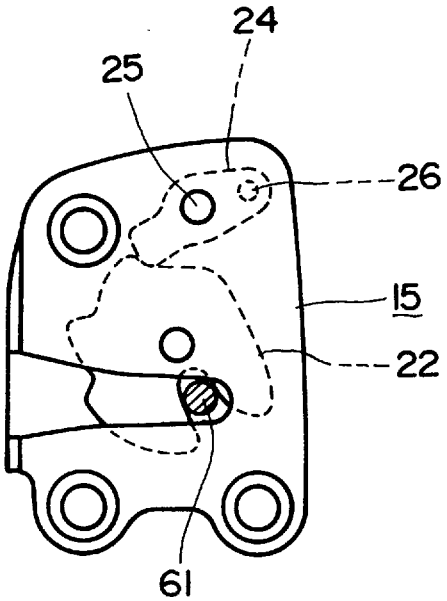
FIG. 5 is a side view of a latch unit.

The latch unit 15 is firmly secured to a sub-plate 21 of the base bracket 14 with screws (not shown). The latch unit 15 is not uniquely discerned from a conventional one except a part thereof to be connected to the arm 8 of the handle lever 5. The latch unit 15 has a fork 22 which is engaged with a striker 61 fixed to a vehicle body and a pawl 24 for maintaining the engagement between the fork 22 and the striker 61, in the front thereof, as shown in FIG. 5. Further, the latch unit 15 has a locking lever 34 connected to the key cylinder 36 through a considerably short rod 37, and an opening lever 28 related to or indirectly connected to the handle lever 5, and an interlocking link 33 provided between the locking lever 34 and the opening lever 28 and a pawl lever 27 connected to the pawl 24 through a pin 26, in the rear thereof, as shown in FIG. 2.

When the locking lever 34 is turned by actuating the key cylinder 36, the locking lever 34 is switched from an unlocked position, in which a pin 32 mounted on the interlocking link 33 is moved in such a manner as to be in opposing relation with an arm 30 of the pawl lever 27, to a locked position in which the pin 32 on the interlocking link 33 is moved in such a way as to be spaced apart from the arm 30 of the pawl lever 27. Thus, when the locking lever 34 is in the unlocked position, actuating the opening lever 28 causes the pin 32 to engage the arm 30 and also causes the pawl lever 27 to rotate. Thereby, the pawl 24 is disengaged from the fork 22, and the door is permitted to be opened. However, when the locking lever 34 is in the locked position, actuating the opening lever 28 does not cause the pin 32, which has been spaced apart from the arm 30, to engage the arm 30, thereby leaving the pawl 24 engaged with the fork and also leaving the door closed.

Hereinafter, the connection between the opening lever 28 and the arm 8 of the handle lever 5 will be described. An arcuately elongated hole 39 is bored in an upper part of the opening lever 28 along an arc centered at a shaft 25. A pin 41 of a connecting link 40 is engaged with the arcuately elongated hole 39 with a lost-motion coupling. A pivoting lever 42 is pivotally movably mounted on a shaft 45 piercing through a projecting piece 44 of the base bracket 14. The other end of the connecting link 40 is connected to a midpoint of the pivoting lever 42 with a pin 43. An end of the pivoting lever 42 is fixed to an end portion of the arm 8 through a shaft 46. The pivoting lever 42 is energized clockwise by a spring 49, as viewed in FIG. 2. The handle lever 5 is held by the resiliency of the spring 49 at a standby position of FIG. 2.

The conventional latch assembly is enclosed in the internal cavity of the door and thus can be seen from neither the interior nor the exterior of the vehicle. In contrast, the latch assembly 3 of the present invention can be also mounted on a place on the panel, which can be seen from the interior or the exterior of the vehicle, by being enclosed by a decorative cover case 62 as illustrated in FIG. 2. Namely, the decorative cover case 62 can surround the connection portion between the handle lever 5 and the latch unit 15 and the connection portion between the key cylinder 36 and the latch unit 15. Thereby, problems associated with the appearance of the conventional assembly can be resolved. The latch assembly 3 of the present invention has an inside lock button or sill knob 38, which is connected to the locking lever 34, and an inner open handle 63 connected to the opening lever 28, similarly as in the case of the conventional latch assembly. These parts should be attached to the outside of the decorative cover 62 from the viewpoints of the improvement of the appearance of the assembly and reduction in the number of parts.

Hereinafter, an assembling operation of this embodiment will be described.

After the latch unit 15, the key cylinder 36 and the pivoting lever 42 are attached to the base bracket 14 of the latch assembly 3, the base bracket 14 and handle base 4 are put into an abutting engagement with the interior surface and exterior surface of the outer panel 1, respectively, and are fixed to each other with the screws 17 and 19 across the outer panel 1.

Next, the U-shaped concave portion 12 of the handle lever 5 is engaged with the supporting portion 13 of the handle base 4, then arm 8 of the handle lever 5 is inserted into the aperture 9 of the handle base 4 and opening 60 of the panel 1. Further, an end of the arm 8 is connected to an end of the pivoting lever 42 through the shaft 46. Thereafter, the latch assembly 3 is covered with the decorative cover case 62, and the inside lock button 38 and the inner open handle 63 are attached to the cover case 62.

As described above, the apparatus of the present invention has a structure in which the outer handle assembly and the latch assembly are fixed to each other. Thus, the outer handle assembly and the latch assembly can be attached to the outer panel 1 in a single operation. Moreover, the structure of the apparatus can be simplified.

Additionally, the latch assembly 3 of the present invention can be mounted on a place, which can be seen from the interior or the exterior of the vehicle, by attaching the decorative cover case 62 to the latch assembly 3.

Although the preferred embodiment of the present invention has been described above, it should be understood that the present invention is not limited thereto and that other modifications will be apparent to those skilled in the art without departing from the spirit of the invention.

The scope of the present invention, therefore, is to be determined solely by the appended claims.

What is claimed is:

1. An opening and closing apparatus on an automotive passenger door comprising;

a latch assembly having a latch mechanism engageable with a striker on an automotive body, an opening mechanism for releasing the latch mechanism from the striker, and a bracket, said latch mechanism and said opening mechanism being mounted on the bracket;

an outer open handle assembly having a handle base, and a handle lever rotatably mounted on the handle base, said handle lever being connected to the opening mechanism through a lost-motion coupling which transmits a movement of the handle lever to the opening mechanism but does not transmit a movement of the opening mechanism to the handle lever; and a door panel of the automotive passengers door having an exposed inside surface and an exposed outside surface;

wherein said bracket has a main plate having a substantially flat outer surface which is brought into contact with the inside surface of the door panel, and a sub plate which is at an approximately right angle to the main plate and extends in a first direction;

wherein said handle base has a substantially flat inner surface which is brought into contact with the outside surface of the door panel;

wherein said latch mechanism and said opening mechanism are mounted on the sub plate;

wherein said main plate and said handle base are fixed to each other with at least one screw or bolt across the door panel so that the door panel is sandwiched between the main plate and the handle base;

wherein said main plate has at least one hole into which the screw or bolt is inserted;

wherein said sub plate has no portion which overlaps with and goes across a plane of the door panel.

2. The apparatus according to claim 1, wherein a thickness of the door panel between the inside surface and the outside surface is shorter than a length of the sub plate of the bracket in the first direction.

3. The apparatus according to claim 1, wherein said handle base has only one supporting portion at one end portion thereof, and a first opening at the other end portion thereof, wherein said handle lever has an engagement portion at one end portion thereof which is rotatably engaged with the supporting portion, and an arm portion at the other end portion thereof which projects through the first opening and a second opening formed in the door panel to an inner side of the door panel, said arm portion being pinned to an intermediate member, said lost-motion coupling having a slot provided in the opening mechanism and a pin formed on the intermediate member and slidably engaged in the slot.

4. The apparatus according to claim 1, wherein said latch assembly has a locking mechanism displaceable between a locked condition for disabling an opening operation of the opening mechanism and an unlocked condition for enabling the opening operation of the opening mechanism, said locking mechanism being mounted on the sub plate of the bracket.

5. An opening and closing apparatus on an automotive passenger door comprising;

a latch assembly having a latch mechanism engageable with a striker on an automotive body, an opening mechanism for releasing the latch mechanism from the striker, an intermediate member connected to the opening mechanism through a lost-motion coupling, a spring for biasing the intermediate member in a predetermined direction, and a bracket, said latch mechanism, said opening mechanism and said intermediate member being mounted on the bracket, said bracket being brought into contact with an inside surface of a door panel of the automotive passenger door;

an outer open handle assembly having an handle base brought into contact with an outside surface of the outer door panel, and a handle lever rotatably mounted on the handle base;

said handle base and said bracket being fixed to each other with screws or bolts across the outer door panel;

wherein said handle base has only one supporting portion at one end portion thereof, and a first opening at the other end portion thereof;

wherein said handle lever has an engagement portion at one end portion thereof which is rotatably engaged with the supporting portion, and an arm portion at the other end portion thereof which projects through the first opening and a second opening formed in the door panel to an inner side of the door panel, said arm portion being connected to the intermediate member by a connecting shaft;

wherein said lost-motion coupling transmits a movement of the intermediate member to the opening mechanism but does not transmit a movement of the opening mechanism to the intermediate member;

wherein the handle lever is held at an initial position thereof by resiliency of the spring when not operated.

6. The apparatus according to claim 5, wherein said opening mechanism has an opening lever rotatably mounted on the bracket, said opening lever having a slot, wherein said intermediate member has a pin slidably engaged with the slot.

7. The apparatus according to claim 6, wherein said intermediate member has a first lever rotatably mounted on the bracket and connected to the arm portion by the connecting shaft, and a second lever rotatably mounted on the first lever and having the pin.

8. An opening and closing apparatus on a vehicle door comprising:

a latch assembly having a latch mechanism engageable with a striker on a vehicle body, an opening lever connected to the latch mechanism for releasing the latch mechanism from the striker, a locking lever connected to a door key cylinder and an inside locking button such that the locking lever can be operated by either the door key cylinder or inside locking button, a locking link having one end connected to the locking lever and the other end slidably engaged with the opening lever, said locking link displaceable between a locked position for disconnecting the opening lever with the latch mechanism and an unlocked position for connecting the opening lever with the latch mechanism, an intermediate member connected to the opening mechanism through a lost-motion coupling, a spring for biasing the intermediate member in a predetermined direction, a bracket on which the latch mechanism, the opening lever, the locking lever and the intermediate member are rotatably mounted, said bracket being brought into contact with an inside surface of a door panel of the vehicle door;

an outer open handle assembly having an handle base brought into contact with an outside surface of the door panel, and a handle lever rotatably mounted on the handle base, said handle lever being connected to the intermediate member;

said handle base and said bracket being fixed to each other with screws or bolts across the door panel;

wherein said lost-motion coupling transmits a movement of the intermediate member to the opening lever but does not transmit a movement of the opening lever to the intermediate member;

wherein the handle lever is held at an initial position thereof by resiliency of the spring when not operated.

9. The apparatus according to claim 8, wherein said handle base has only one supporting portion at one end portion thereof, and a first opening at the other end portion thereof, wherein said handle lever has an engagement portion at one end portion thereof which is rotatably engaged with the supporting portion, and an arm portion at the other end portion thereof which projects through the first opening and a second opening formed in the door panel to an inner side of the door panel.

10. An opening and closing apparatus on an automotive passenger door comprising:

a door panel of the automotive passenger door having an exposed inside surface and an exposed outside surface;

a latch assembly having a latch mechanism engageable with a striker on an automotive body, an opening mechanism for releasing the latch mechanism from the striker, and a bracket, said latch mechanism and said opening mechanism being mounted on the bracket, said bracket being brought into contact with the inside surface of the door panel;

an outer open handle assembly having a handle base brought into contact with the outside surface of the door panel, and a handle lever rotatably mounted on the handle base, said handle base having only one supporting portion at one end portion thereof and a first opening at the other end portion thereof, said handle lever having an engagement portion at one end portion thereof which is rotatably engaged with the supporting portion and an arm portion at the other end portion thereof which projects through the first opening and a second opening formed in the door panel to an inner side of the door panel;

an intermediate member having one end connected to the opening mechanism through a lost-motion coupling and the other end pinned to the arm portion; and a spring for biasing the intermediate member in a predetermined direction;

wherein said handle base and said bracket being fixed to each other with screws or bolts across the door panel;

wherein said lost-motion coupling transmits a movement of the intermediate member to the opening mechanism but does not transmit a movement of the opening mechanism to the intermediate member;

wherein the handle lever is held at an initial position thereof by resiliency of the spring when not operated.

11. The apparatus according to claim 10, wherein said bracket has a main plate having a substantially flat outer surface which is brought into contact with the inside surface of the door panel, and a sub plate which is at an approximately right angle to the main plate and extends in a first direction, and wherein a thickness of the door panel between the inside surface and the outside surface is shorter than a length of the sub plate of the bracket in the first direction.

12. The apparatus according to claim 11, wherein said sub plate is not overlapped with a plane of the door panel.

13. The apparatus according to claim 12, wherein said opening mechanism has an opening lever rotatably mounted on the bracket, said opening lever having a slot, wherein said intermediate member has a pin slidably engaged with the slot.

14. The apparatus according to claim 13, wherein said intermediate member has a first lever rotatably mounted on the bracket and connected to the arm portion by a connecting shaft, and a second lever rotatably mounted on the first lever and having the pin.

* * * * *